US009550955B2

(12) United States Patent
Loper et al.

(10) Patent No.: US 9,550,955 B2
(45) Date of Patent: Jan. 24, 2017

(54) FRICTION MODIFIERS FOR LUBRICATING OILS

(71) Applicant: Afton Chemical Corporation, Richmond, VA (US)

(72) Inventors: John T. Loper, Richmond, VA (US); Jeremy P. Styer, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 462 days.

(21) Appl. No.: 13/725,482

(22) Filed: Dec. 21, 2012

(65) Prior Publication Data

US 2014/0179571 A1 Jun. 26, 2014

(51) Int. Cl.

| | |
|---|---|
| ***C10L 1/22*** | (2006.01) |
| ***C10M 169/00*** | (2006.01) |
| ***C10M 169/04*** | (2006.01) |
| ***C10M 137/10*** | (2006.01) |
| ***C10M 133/48*** | (2006.01) |
| ***C10M 159/12*** | (2006.01) |
| ***C10M 133/16*** | (2006.01) |

(52) U.S. Cl.

CPC ..... *C10M 133/48* (2013.01); *C10M 133/16* (2013.01); *C10M 159/12* (2013.01); *C10M 2207/262* (2013.01); *C10M 2215/08* (2013.01); *C10M 2215/082* (2013.01); *C10M 2215/225* (2013.01); *C10M 2215/28* (2013.01); *C10M 2219/044* (2013.01); *C10M 2219/046* (2013.01); *C10M 2223/042* (2013.01); *C10M 2223/045* (2013.01); *C10N 2210/02* (2013.01); *C10N 2210/04* (2013.01); *C10N 2230/06* (2013.01); *C10N 2230/56* (2013.01); *C10N 2240/10* (2013.01); *C10N 2240/101* (2013.01); *C10N 2240/102* (2013.01); *C10N 2240/103* (2013.01); *C10N 2240/104* (2013.01); *C10N 2240/105* (2013.01); *C10N 2240/106* (2013.01)

(58) Field of Classification Search

CPC ..... C10M 117/02; C10M 114/04
USPC ..... 508/277, 278, 369
See application file for complete search history.

(56) References Cited

U.S. PATENT DOCUMENTS

| | | | | |
|---|---|---|---|---|
| 2,905,644 | A | 9/1959 | Butter et al. | |
| 3,156,652 | A | 11/1964 | Foehr | |
| 3,156,653 | A | 11/1964 | Foehr | |
| 3,324,155 | A | 6/1967 | Thompson et al. | |
| 3,640,872 | A | 2/1972 | Wiley et al. | |
| 3,652,410 | A | 3/1972 | Hollinghurst et al. | |
| 3,879,306 | A | 4/1975 | Kablaoui et al. | |
| 3,933,659 | A | 1/1976 | Lyle et al. | |
| 4,035,309 | A | 7/1977 | Brois | |
| 4,097,389 | A | 6/1978 | Andress, Jr. | |
| 4,162,224 | A | 7/1979 | Bridger | |
| 4,374,032 | A | 2/1983 | Gemmill et al. | |
| 4,375,418 | A * | 3/1983 | Zoleski et al. | 508/277 |
| 4,536,307 | A | 8/1985 | Horodysky | |
| 4,618,436 | A * | 10/1986 | Horodysky | 508/188 |
| 5,062,890 | A | 11/1991 | Miyashita et al. | |
| 5,131,921 | A | 7/1992 | Sung et al. | |
| 5,334,329 | A | 8/1994 | Vinci | |
| 5,569,407 | A | 10/1996 | Avery et al. | |
| 5,700,766 | A | 12/1997 | Hellsten et al. | |
| 6,451,745 | B1 | 9/2002 | Ward | |
| 7,977,287 | B1 | 7/2011 | Hicks et al. | |
| 8,084,403 | B2 | 12/2011 | Lam et al. | |
| 8,303,850 | B2 | 11/2012 | Shibata et al. | |
| 2007/0155631 | A1 | 7/2007 | Muir | |
| 2011/0030269 | A1 | 2/2011 | Chasen et al. | |
| 2011/0118157 | A1 | 5/2011 | Cook et al. | |

FOREIGN PATENT DOCUMENTS

| | | | |
|---|---|---|---|
| CN | 1274743 | A | 11/2000 |
| CN | 102329681 | A | 1/2012 |

(Continued)

OTHER PUBLICATIONS

European Search Report; Mailed Aug. 13, 2014 for related EP Application No. EP 13199016.0.

(Continued)

*Primary Examiner* — Prem C Singh
*Assistant Examiner* — Francis C Campanell
(74) *Attorney, Agent, or Firm* — Mendelsohn, Drucker & Dunleavy, P.C.

(57) ABSTRACT

A lubricating oil comprises a major amount of a base oil and a minor amount of an additive package, and the additive package comprises at least one friction modifier of formula I:

(I)

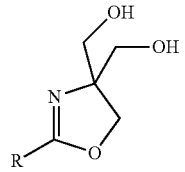

where R is a linear or branched, saturated, unsaturated, or partially saturated hydrocarbyl having about 8 to about 22 carbon atoms or R is represented by:

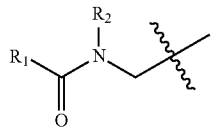

and $R_1$ is a linear or branched, saturated, unsaturated, or partially saturated hydrocarbyl having about 8 to about 22 carbon atoms and $R_2$ is hydrogen or a hydrocarbyl having about 1 to about 2 carbon atoms. Methods of using the lubricating oil to improve thin film and/or boundary layer friction in an engine are also disclosed.

28 Claims, No Drawings

(56) References Cited

FOREIGN PATENT DOCUMENTS

| | | | |
|---|---|---|---|
| CN | 102498194 | A | 6/2012 |
| DE | 122102 | A1 | 9/1976 |
| EP | 0714974 | A1 | 6/1996 |
| EP | 0798367 | A2 | 10/1997 |
| EP | 1354933 | A1 | 10/2003 |
| EP | 1661968 | A1 | 5/2006 |
| EP | 1734103 | A1 | 12/2006 |
| EP | 1881057 | A1 | 1/2008 |
| EP | 2371935 | A1 | 10/2011 |
| EP | 2610330 | A1 | 7/2013 |
| GB | 951139 | A | 3/1964 |
| GB | 1099736 | A | 1/1968 |
| JP | H0665589 | A | 3/1994 |
| WO | WO9936491 | A2 | 7/1999 |
| WO | WO0071649 | A1 | 11/2000 |
| WO | WO2010033447 | A2 | 3/2010 |
| WO | WO2010092010 | A1 | 8/2010 |
| WO | W02011017555 | A1 | 2/2011 |

OTHER PUBLICATIONS

Non-Final Office Action; Mailed May 15, 2014 for related U.S. Appl. No. 13/725,411.
European Search Report; Mailed Jul. 18, 2014 for related EP Application No. EP 13199033.5.
Non-Final Office Action; Mailed May 19, 2014 for related U.S. Appl. No. 13/725,446.
European Search Report; Mailed Apr. 16, 2014 for related EP Application No. EP 13199044.
Non-Final Office Action; Mailed May 19, 2014 or related U.S. Appl. No. 13/725,290.
European Search Report; Mailed May 2, 2014 for related EP Application No. EP 13199054.1.
Final Office Action; Mailed Oct. 8, 2014 for related U.S. Appl. No. 13/725,290.
Final Office Action; Mailed Oct. 14, 2014 for related U.S. Appl. No. 13/725,411.
Advisory Action; Mailed Dec. 22, 2014 for the relation U.S. Appl. No. 13/725,411.
Advisory Action; Mailed Dec. 16, 2014 for the relation U.S. Appl. No. 13/725,446.
Advisory Action; Mailed Dec. 22, 2014 for the relation U.S. Appl. No. 13/725,319.
Advisory Action; Mailed Dec. 17, 2014 for the relation U.S. Appl. No. 13/725,290.
Non-Final Office Action; Mailed Mar. 6, 2015 for related U.S. Appl. No. 13/725,411.
Non-Final Office Action; Mailed Mar. 6, 2015 for related U.S. Appl. No. 13/725,446.
Non-Final Office Action; Mailed Mar. 4, 2015 for related U.S. Appl. No. 13/725,216.
Chinese Office Action; Mailed Mar. 30, 2015 for related CN Application No. CN201310716432.8.
Chinese Office Action; Mailed Mar. 30, 2015 for related CN Application No. CN201310714844.8.
Chinese Office Action; Mailed Mar. 2, 2015 for related CN Application No. CN201310716602.2.
Non-Final Office Action; Mailed Mar. 12, 2015 for related U.S. Appl. No. 13/725,290.
European Search Report; Mailed Aug. 13, 2014 for related EP Application No. EP 13198977.4.
Non-Final Office Action; Mailed May 21, 2014 for related U.S. Appl. No. 13/725,319.
"The Advent of Modern Hydroprocessing—The Evolution of Base Oil Technology—Part 2," Machinery Lubrication, May 2003, pp. 1-6 from Chevron Global Lubricants.
European Search Report; Mailed Apr. 16, 2014 for related EP Application No. EP 13199141.6.
Non-Final Office Action; Mailed May 27, 2014 for the related U.S. Appl. No. 13/725,216.
Final Office Action; Mailed Oct. 7, 2014 for related U.S. Appl. No. 13/725,411.
Final Office Action; Mailed Oct. 14, 2014 for related U.S. Appl. No. 13/725,319.
Final Office Action; Mailed Oct. 8, 2014 or related U.S. Appl. No. 13/725,446.
Final Office Action; Mailed Oct. 14, 2014 for related U.S. Appl. No. 13/725,216.
Final Office Action; Mailed Sep. 2, 2015 for U.S. Appl. No. 13/725,319.
Final Office Action; Mailed Sep. 22, 2015 for U.S. Appl. No. 13/725,216.

* cited by examiner

FRICTION MODIFIERS FOR LUBRICATING OILS

BACKGROUND

1. Field

The present disclosure is directed to additive compositions and lubricants containing oxazoline derivatives. In particular, it is directed to additive compositions and lubricants containing hydrocarbyl oxazolines as friction modifiers for reducing thin film friction and/or boundary layer friction.

2. Description of the Related Technology

To ensure smooth operation of engines, engine oils play an important role in lubricating a variety of sliding parts in the engine, for example, piston rings/cylinder liners, bearings of crankshafts and connecting rods, valve mechanisms including cams and valve lifters, and the like. Engine oils may also play a role in cooling the inside of an engine and dispersing combustion products. Further possible functions of engine oils may include preventing or reducing rust and corrosion.

The principle consideration for engine oils is to prevent wear and seizure of parts in the engine. Lubricated engine parts are mostly in a state of fluid lubrication, but valve systems and top and bottom dead centers of pistons are likely to be in a state of boundary lubrication. The friction between these parts in the engine may cause significant energy losses and thereby reduce fuel efficiency. Many types of friction modifiers have been used in engine oils to decrease frictional energy losses.

Improved fuel efficiency may be achieved when friction between engine parts is reduced. Thin-film friction is the friction generated by a fluid, such as a lubricant, moving between two surfaces, when the distance between the two surfaces is very small. It is known that some additives normally present in engine oils form films of different thicknesses, which can have an effect on thin-film friction. Some additives, such as zinc dialkyl dithio phosphate (ZDDP) are known to increase thin-film friction. Though such additives may be required for other reasons such as to protect engine parts, the increase in thin-film friction caused by such additives can be detrimental.

Reducing boundary layer friction in engines may also enhance fuel efficiency. The motion of contacting surfaces in an engine may be retarded by boundary layer friction. Non-nitrogen-containing, nitrogen-containing, and molybdenum-containing friction modifiers are sometimes used to reduce boundary layer friction.

Rudnick, "Lubricant additives: chemistry and applications," $2^{nd}$ ed., Page 17, CRC Press, 2009 discloses that copper salts of mono-oxazoline or bis-oxazoline have improved varnish control and oxidation inhibition capabilities in lubricants.

U.S. Pat. No. 4,162,224 discloses a lubricating composition containing a reaction product of boric acid, substituted phenol and bis-oxazoline or oxazoline, where the oxazoline has formula:

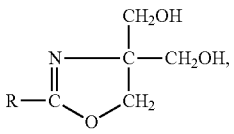

where R is a straight, ranched chain or cycloalkyl group containing from 4 to 30 carbon atoms. The compound is said to impart a desired degree of antiwear and/or antioxidant protection to the lubricant composition. The patent contemplates using the lubricant composition for a machine or an engine.

U.S. Pat. No. 4,618,436 discloses a multifunctional lubricant composition comprising an internal acid phosphate salt of a borated oxazoline, where the oxazoline has formula:

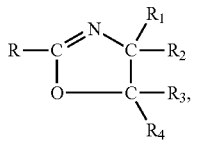

where R is selected from about $C_8$ to about $C_{30}$ hydrocarbyl or

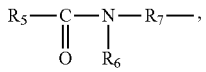

such as an acyl sarcosine-derived substituent or mixture thereof, at least one of $R_1$, $R_2$, $R_3$, $R_4$ is hydroxyalkyl having from 1 to about 6 carbon atoms and the remaining of $R_1$, $R_2$, $R_3$, $R_4$ are independently selected from the group consisting of $C_1$ to about $C_{30}$ hydrocarbyl, $C_1$ to about $C_6$ hydroxyalkyl, hydrogen or

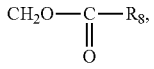

where $R_8$ is hydrogen or $C_1$ to about $C_6$ hydrocarbyl, or

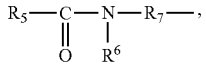

or mixtures thereof, $R_5$ is about $C_{30}$ hydrocarbyl, $R_6$ is $C_1$ to about $C_6$ hydrocarbyl and $R_7$ is $C_1$ to about $C_3$ hydrocarbylene. The lubricant composition may also contain other components, such as corrosion inhibitors, extreme pressure agents, viscosity index improvers, co-antioxidants, other antiwear agents and the like. The lubricant composition is said to be capable of reducing the friction of an engine operating with oil in its crankcase.

U.S. Pat. No. 4,097,389 discloses a lubricant composition containing a borated product of a compound of the formula:

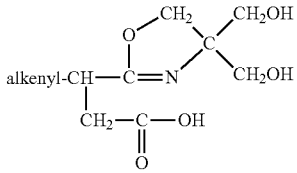

as a detergent, with the alkenyl group containing 1 to 30 carbon atoms. Other additives that may be used in the lubricant composition include other detergents, viscosity improvement agents, extreme pressure additives, and oxidation stability additives.

U.S. Pat. No. 4,035,309 discloses a lubricant composition comprising a reaction product that predominantly comprises a compound of formula:

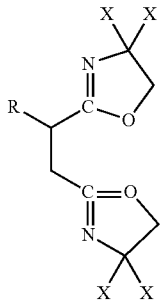

where R is the hydrocarbyl group of succinic anhydride, and each X may represent a —$CH_3OH$ group. The lubricant composition may be used in automotive crankcase, automatic transmission fluids, or in petroleum fuels such as gasoline. Additional additives such as a viscosity index improver, a pour point depressant, or a zinc dialkyldithiophosphate antiwear agent may also be included in the lubricant composition.

In recent years there has been a growing desire to employ lubricants that provide higher energy-efficiency, especially lubricants that reduce friction by employment of friction modifiers in the lubricants. The present disclosure provides an improved lubricant composition that may reduce one or both of thin film friction and boundary layer friction.

SUMMARY

In one aspect, the present disclosure provides a lubricating oil comprising a major amount of a base oil and a minor the amount of an additive package, wherein the additive package comprises one or more friction modifiers of the Formula I:

(I)

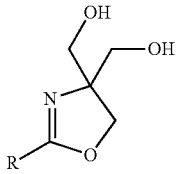

wherein R is a linear or branched, saturated, unsaturated, or partially saturated hydrocarbyl having about 8 to about 22 carbon atoms or wherein R is represented by:

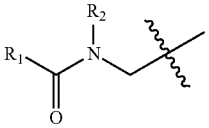

and $R_1$ is a linear or branched, saturated, unsaturated, or partially saturated hydrocarbyl having about 8 to about 22 carbon atoms and $R_2$ is hydrogen or a hydrocarbyl having about 1 to about 2 carbon atoms.

In another aspect, the present disclosure provides a lubricating oil comprising a major amount of a base oil and a minor the amount of an additive package, wherein the additive package comprises one or more friction modifiers comprising the reaction product of an aliphatic carboxylic acid of formula (II):

(II)

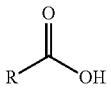

and an amino hydroxy compound of formula (III):

(III)

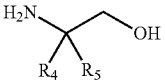

wherein R is a linear or branched, saturated, unsaturated, or partially saturated hydrocarbyl having about 8 to about 22 carbon atoms or wherein R is

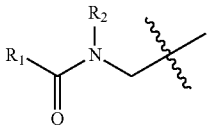

and $R_1$ is a linear or branched, saturated, unsaturated, or partially saturated hydrocarbyl having about 8 to about 22 carbon atoms and $R_2$ is hydrogen or a hydrocarbyl having about 1 to about 2 carbon atoms, and wherein $R_4$ and $R_5$ are the same or are independently hydrogen or hydroxy methylene.

The additive package may comprise at least two friction modifiers.

The additive package may comprise at least two friction modifiers of the Formula I.

R of the formula I may have from about 8 to about 18 carbon atoms. Alternatively, R is represented by:

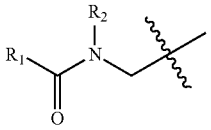

and $R_1$ has from about 10 to about 20 carbon atoms. Alternatively, $R_1$ has from about 10 to about 18 carbon atoms. $R_2$ may be hydrogen or a methyl group.

In another aspect, the present disclosure provides a lubricating oil comprising a major amount of a base oil and a minor the amount of an additive package, wherein the additive package comprises one or more friction modifiers comprising the reaction product of an aliphatic carboxylic acid of formula (II):

(II)

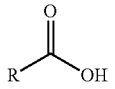

and an amino hydroxyl compound of formula (III):

(III)

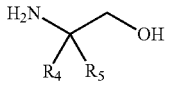

wherein R is a linear or branched, saturated, unsaturated, or partially saturated hydrocarbyl having about 8 to about 22 carbon atoms or wherein R is

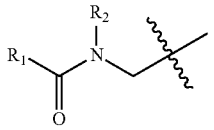

and $R_1$ is a linear or branched, saturated, unsaturated, or partially saturated hydrocarbyl having about 8 to about 22 carbon atoms and $R_2$ is hydrogen or a hydrocarbyl having about 1 to about 2 carbon atoms, and wherein $R_4$ and $R_5$ are the same or are independently hydrogen or hydroxy methylene.

The additive package of the lubricating oil the additive package may further include at least one additive selected from the group consisting of antioxidants, antifoam agents, titanium-containing compounds, phosphorus-containing compounds, viscosity index improvers, pour point depressants, and diluent oils.

The lubricating oil may be an engine oil.

The lubricating oil may further include at least one metal dialkyl dithio phosphate salt. The at least one metal dialkyl dithio phosphate salt may comprise at least one zinc dialkyl dithio phosphate represented by the following formula:

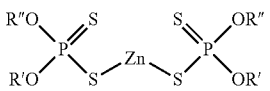

wherein R' and R" may be the same or different hydrocarbyl moieties containing from 1 to 18, carbon atoms and the total number of carbon atoms in the zinc dialkyl dithio phosphate is at least 5. The R' and R" groups may be independently selected from ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, and butenyl. The alkyl groups of the at least one metal dialkyl dithio phosphate salt may be derived from primary alcohols, secondary alcohols, or mixtures of primary and secondary alcohols.

The lubricating oil may comprise one or more dispersants.

The at least one dispersant may comprise a polyalkylene succinimide.

The at least one dispersant may comprise a polyisobutylene succininimide having a polyisobutylene residue derived from polyisobutylene having a number average molecular weight of greater than 900. Alternatively, the at least one dispersant may comprise a polyisobutylene succininimide having a polyisobutylene residue derived from polyisobutylene with a number average molecular weight of from about 1200 to about 5000.

The polyalkylene succinimide may be post-treated with one or more compounds selected from boron compounds, anhydrides, aldehydes, ketones, phosphorus compounds, epoxides, and carboxylic acids. The polyisobutylene succinimide may be post-treated with a boron compound and wherein the boron content of the lubricating oil is from about 200 to 500 ppm boron.

The at least one dispersant may comprise a polyisobutylene succinimide comprising a polyisobutylene residue derived from a polyisobutylene having greater than 50% terminal vinylidene.

The polyisobutylene succinimide dispersant may be derived from an amine selected from trialkyleneamine tetramine and tetralkylene pentamine.

The total amount of dispersant may be less than about 20 wt. % of a total weight of the lubricating oil. Alternatively, the total amount of dispersant may be in a range of from 0.1 wt. % to 15 wt. % of a total weight of the lubricating oil.

The lubricating oil may comprise one or more detergents.

The at least one detergent may comprise two or more detergents. The first detergent may have a total base number of 40 to 450 and the second detergent may have a total base number of up to 80.

The at least one detergent may comprise a sulfonate, a phenate, or a salicylate.

The at least one detergent may comprise at least one compound selected from calcium sulfonate, magnesium sulfonate, sodium sulfonate, calcium phenate, sodium phenate, calcium salicylate, and sodium salicylate.

The at least one detergent may comprise a metal salt wherein the metal is selected from the group consisting of alkaline and alkaline earth metals.

The total base number of the at least one detergent may be up to about 450. Alternatively, the total base number of the at least one detergent may be from about 80 to about 350.

In another aspect, the present disclosure relates to a method for improving thin film and boundary layer friction in an engine comprising the step of lubricating the engine with a lubricating oil as described above. In the method, the improved thin film and boundary layer friction may be determined relative to a same composition in the absence of the one or more friction modifiers as described above.

In yet another aspect, the present disclosure relates to a method for improving boundary layer friction in an engine, comprising the step of lubricating the engine with a lubricating oil as described above. The improved boundary layer friction may be determined relative to a same composition in the absence of the one or more friction modifiers described above.

In a further aspect, the present disclosure relates to a method for improving thin film friction in an engine, comprising the step of adding to the engine a lubricating oil described above. The improved thin film friction may be determined relative to a same composition in the absence of the one or more friction modifiers as described above.

DEFINITIONS

The following definitions of terms are provided in order to clarify the meanings of certain terms as used herein.

It must be noted that as used herein and in the appended claims, the singular forms "a," "an," and "the" include plural references unless the context clearly dictates otherwise. Furthermore, the terms "a" (or "an"), "one or more," and "at least one" can be used interchangeably herein. The terms "comprising," "including," "having," and "constructed from" can also be used interchangeably.

Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It is to be understood that each component, compound, substituent, or parameter disclosed herein is to be interpreted as being disclosed for use alone or in combination with one or more of each and every other component, compound, substituent, or parameter disclosed herein.

It is also to be understood that each amount/value or range of amounts/values for each component, compound, substituent, or parameter disclosed herein is to be interpreted as also being disclosed in combination with each amount/value or range of amounts/values disclosed for any other component(s), compounds(s), substituent(s), or parameter(s) disclosed herein and that any combination of amounts/values or ranges of amounts/values for two or more component(s), compounds(s), substituent(s), or parameters disclosed herein are thus also disclosed in combination with each other for the purposes of this description.

It is further understood that each lower limit of each range disclosed herein is to be interpreted as disclosed in combination with each upper limit of each range disclosed herein for the same component, compounds, substituent, or parameter. Thus, a disclosure of two ranges is to be interpreted as a disclosure of four ranges derived by combining each lower limit of each range with each upper limit of each range. A disclosure of three ranges is to be interpreted as a disclosure of nine ranges derived by combining each lower limit of each range with each upper limit of each range, etc. Furthermore, specific amounts/values of a component, compound, substituent, or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent, or parameter.

The terms "oil composition," "lubrication composition," "lubricating oil composition," "lubricating oil," "lubricant composition," "lubricating composition," "fully formulated lubricant composition," and "lubricant," are considered to be synonymous, fully interchangeable terms referring to the finished lubrication product comprising a major amount of a base oil plus a minor amount of an additive composition.

The terms, "crankcase oil," "crankcase lubricant," "engine oil," "engine lubricant," "motor oil," and "motor lubricant" are considered to be synonymous, fully interchangeable terms referring to the finished engine, motor or crankcase lubrication product comprising a major amount of a base oil plus a minor amount of an additive composition.

As used herein, the terms "additive package," "additive concentrate," and "additive composition," are considered to be synonymous, fully interchangeable terms referring the portion of the lubricating composition excluding the major amount of base oil stock. The additive package may or may not include a viscosity index improver or pour point depressant.

As used herein, the terms "engine oil additive package," "engine oil additive concentrate," "crankcase additive package," "crankcase additive concentrate," "motor oil additive package," and "motor oil concentrate," are considered to be synonymous, fully interchangeable terms referring the portion of the lubricating composition excluding the major amount of base oil stock. The engine, crankcase, or motor oil additive package may or may not include a viscosity index improver or pour point depressant.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. "Group" and "moiety" as used herein are intended to be interchangeable. Examples of hydrocarbyl groups include:

(a) hydrocarbon substituents, that is, aliphatic substituents (e.g., alkyl or alkenyl), alicyclic substituents (e.g., cycloalkyl, cycloalkenyl), and aromatic-, aliphatic-, and alicyclic-substituted aromatic substituents, as well as cyclic substituents wherein the ring is completed through another portion of the molecule (e.g., two substituents together form an alicyclic moiety);

(b) substituted hydrocarbon substituents, that is, substituents containing non-hydrocarbon groups which, in the context of this disclosure, do not materially alter the predominantly hydrocarbon character of the substituent (e.g., halo (especially chloro and fluoro), hydroxy, alkoxy, mercapto, alkylmercapto, nitro, nitroso, amino, alkylamino, and sulfoxy); and (c) hetero substituents, that is, substituents which, while having a predominantly hydrocarbon character, in the context of this disclosure, contain atoms other than carbon atoms in a ring or chain otherwise composed of carbon atoms. Heteroatoms may include sulfur, oxygen, and nitrogen, and hetero substituents encompass substituents such as pyridyl, furyl, thienyl, and imidazolyl. In general, no more than two, for example or no more than one, non-hydrocarbon substituent will be present for every ten carbon atoms in the hydrocarbyl group. Typically, there are no non-hydrocarbon substituents in the hydrocarbyl group.

As used herein, the term "percent by weight", unless expressly stated otherwise, means the percentage that the recited component(s), compounds(s), or substituent(s) represents of the total weight of the entire composition.

The terms "soluble," "oil-soluble," and "dispersible" as used herein may, but do not necessarily, indicate that the compounds or additives are soluble, dissolvable, miscible, or capable of being suspended in the oil in all proportions. The foregoing terms do mean, however, that the component(s), compounds(s), or additive(s) are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular oil soluble, or dispersible compound or additive, if desired.

The term "TBN" as employed herein is used to denote the Total Base Number in mg KOH/g as measured by the method of ASTM D2896 or ASTM D4739.

The term "alkyl" as employed herein refers to straight, branched, cyclic, and/or substituted saturated moieties having a carbon chain of from about 1 to about 100 carbon atoms.

The term "alkenyl" as employed herein refers to straight, branched, cyclic, and/or substituted unsaturated moieties having a carbon chain of from about 3 to about 10 carbon atoms.

The term "aryl" as employed herein refers to single and multi-ring aromatic compounds that may include alkyl, alkenyl, alkylaryl, amino, hydroxyl, alkoxy and/or halo substituents, and/or heteroatoms including, but not limited to, nitrogen, oxygen, and sulfur.

Lubricants, combinations of component(s) or compounds(s), or individual component(s) or compounds(s) of the present description may be suitable for use in various types of internal combustion engines. Suitable engine types may include, but are not limited to heavy duty diesel, passenger car, light duty diesel, medium speed diesel, or marine engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or combinations thereof. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines to which the embodiments may be applied include marine diesel engines, aviation piston engines, low-load diesel engines, and motorcycle, automobile, locomotive, and truck engines.

The internal combustion engine may contain component(s) comprising one or more of an aluminum-alloy, lead, tin, copper, cast iron, magnesium, ceramics, stainless steel, composites, and/or combinations thereof. The component(s) may be coated, for example, with a diamond-like carbon coating, a lubricated coating, a phosphorus-containing coating, a molybdenum-containing coating, a graphite coating, a nano-particle-containing coating, and/or combinations or mixtures thereof. The aluminum-alloy may include aluminum silicates, aluminum oxides, or other ceramic materials. In an embodiment the aluminum-alloy comprises an aluminum-silicate surface. As used herein, the term "aluminum alloy" is intended to be synonymous with "aluminum composite" and to describe a component or surface comprising aluminum and one or more other component(s) intermixed or reacted on a microscopic or nearly microscopic level, regardless of the detailed structure thereof. This would include any conventional alloys with metals other than aluminum as well as composite or alloy-like structures with non-metallic elements or compounds such as with ceramic-like materials.

The lubricant composition for an internal combustion engine may be suitable for any engine lubricant irrespective of the sulfur, phosphorus, or sulfated ash (ASTM D-874) content. The sulfur content of the engine lubricant may be about 1 wt. % or less, or about 0.8 wt. % or less, or about 0.5 wt. % or less, or about 0.3 wt. % or less. In an embodiment the sulfur content may be in the range of about 0.001 wt. % to about 0.5 wt. %, or about 0.01 wt. % to about 0.3 wt. %. The phosphorus content may be about 0.2 wt. % or less, or about 0.1 wt. % or less, or about 0.085 wt. % or less, or about 0.08 wt. % or less, or even about 0.06 wt. % or less, about 0.055 wt. % or less, or about 0.05 wt. % or less. In an embodiment the phosphorus content may be about 50 ppm to about 1000 ppm, or about 325 ppm to about 850 ppm. The total sulfated ash content may be about 2 wt. % or less, or about 1.5 wt. % or less, or about 1.1 wt. % or less, or about 1 wt. % or less, or about 0.8 wt. % or less, or about 0.5 wt. % or less. In an embodiment the sulfated ash content may be about 0.05 wt. % to about 0.9 wt. %, or about 0.1 wt. % to about 0.7 wt. % or about 0.2 wt. % to about 0.45 wt. %. In another embodiment, the sulfur content may be about 0.4 wt. % or less, the phosphorus content may be about 0.08 wt. % or less, and the sulfated ash content may be about 1 wt. % or less. In yet another embodiment the sulfur content may be about 0.3 wt. % or less, the phosphorus content may be about 0.05 wt. % or less, and the sulfated ash may be about 0.8 wt. % or less.

In an embodiment the lubricating composition is may have: (i) a sulfur content of about 0.5 wt. % or less, (ii) a phosphorus content of about 0.1 wt. % or less, and (iii) a sulfated ash content of about 1.5 wt. % or less.

In an embodiment the lubricating composition is suitable for a 2-stroke or a 4-stroke marine diesel internal combustion engine. In an embodiment the marine diesel combustion engine is a 2-stroke engine.

Further, lubricants of the present description may be suitable to meet one or more industry specification requirements such as ILSAC GF-3, GF-4, GF-5, GF-6, PC-11, CI-4, CJ-4, ACEA A1/B1, A2/B2, A3/B3, A5/B5, C1, C2, C3, C4, E4/E6/E7/E9, Euro 5/6, Jaso DL-1, Low SAPS, Mid SAPS, or original equipment manufacturer specifications such as Dexos™ 1, Dexos™ 2, MB-Approval 229.51/229.31, VW 502.00, 503.00/503.01, 504.00, 505.00, 506.00/506.01, 507.00, BMW Longlife-04, Porsche C30, Peugeot Citroën Automobiles B71 2290, Ford WSS-M2C153-H, WSS-M2C930-A, WSS-M2C945-A, WSS-M2C913A, WSS-M2C913-B, WSS-M2C913-C, GM 6094-M, Chrysler MS-6395, or any past or future PCMO or HDD specifications not mentioned herein. In some embodiments for passenger car motor oil (PCMO) applications, the amount of phosphorus in the finished fluid is 1000 ppm or less or 900 ppm or less or 800 ppm or less.

Other hardware may not be suitable for use with the disclosed lubricant. A "functional fluid" is a term which encompasses a variety of fluids including but not limited to tractor hydraulic fluids, power transmission fluids including automatic transmission fluids, continuously variable transmission fluids, and manual transmission fluids, other hydraulic fluids, some gear oils, power steering fluids, fluids used in wind turbines and compressors, some industrial fluids, and fluids used in relation to power train component. It should be noted that within each class of these fluids such as, for example, automatic transmission fluids, there are a variety of different types of fluids due to the various apparatus/transmissions having different designs which have led to the need for specialized fluids having markedly different functional characteristics. This is contrasted by the term "lubricating fluid" which is used to denote a fluid that is not used to generate or transfer power as do the functional fluids.

With respect to tractor hydraulic fluids, for example, these fluids are all-purpose products used for all lubricant applications in a tractor except for lubricating the engine. These lubricating applications may include lubrication of gearboxes, power take-off and clutch(es), rear axles, reduction gears, wet brakes, and hydraulic accessories.

When a functional fluid is an automatic transmission fluid, the automatic transmission fluid must have enough friction for the clutch plates to transfer power. However, the friction coefficient of such fluids has a tendency to decline due to temperature effects as the fluids heat up during operation. It is important that such tractor hydraulic fluids or automatic transmission fluids maintain a high friction coefficient at elevated temperatures, otherwise brake systems or automatic transmissions may fail. This is not a function of engine oils.

Tractor fluids, and for example Super Tractor Universal Oils (STUOs) or Universal Tractor Transmission Oils (UTTOs), may combine the performance of engine oils with one or more adaptations for transmissions, differentials, final-drive planetary gears, wet-brakes, and hydraulic performance. While many of the additives used to formulate a UTTO or a STUO fluid are similar in functionality, they may have deleterious effects if not incorporated properly. For example, some anti-wear and extreme pressure additives used in engine oils can be extremely corrosive to the copper component in hydraulic pumps. Detergents and dispersants used for gasoline or diesel engine performance may be detrimental to wet brake performance. Friction modifiers used to quiet wet brake noise may lack the thermal stability required for engine oil performance. Each of these fluids, whether functional, tractor, or lubricating, are designed to meet specific and stringent manufacturer requirements associated with their intended purpose.

Lubricating oil compositions of the present disclosure may be formulated in an appropriate base oil by the addition of one or more additives. The additives may be combined with the base oil in the form of an additive package (or concentrate) or, alternatively, may be combined individually with the base oil. The fully formulated lubricant may exhibit improved performance properties, based on the additives employed in the composition and the respective proportions of these additives.

The present disclosure includes novel lubricating oil blends specifically formulated for use as automotive crankcase lubricants. Embodiments of the present disclosure may provide lubricating oils suitable for crankcase applications and having improvements in the following characteristics: air entrainment, alcohol fuel compatibility, antioxidancy, antiwear performance, biofuel compatibility, foam reducing properties, friction reduction, fuel economy, preignition prevention, rust inhibition, sludge and/or soot dispersability, and water tolerance.

Additional details and advantages of the disclosure will be set forth in part in the description which follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only and are not restrictive of the scope of the disclosure, as claimed.

DETAILED DESCRIPTION

For illustrative purposes, the principles of the present disclosure are described by referencing various exemplary embodiments. Although certain embodiments are specifically described herein, one of ordinary skill in the art will readily recognize that the same principles are equally applicable to, and can be employed in other systems and methods. Before explaining the disclosed embodiments in detail, it is to be understood that the disclosure is not limited in its application to the details of any particular embodiment shown. Additionally, the terminology used herein is for the purpose of description and not of limitation. Furthermore, although certain methods are described with reference to steps that are presented herein in a certain order, in many instances, these steps may be performed in any order as may be appreciated by one skilled in the art; the novel method is therefore not limited to the particular arrangement of steps disclosed herein.

In one aspect, the present disclosure provides a lubricating oil comprising a major amount of a base oil and a minor amount of an additive package, wherein the additive package comprises one or more friction modifiers of Formula I:

(I)

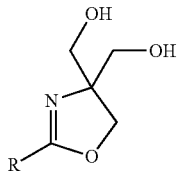

where R is a linear or branched, saturated, unsaturated, or partially saturated hydrocarbyl having about 8 to about 22 carbon atoms or wherein R is represented by:

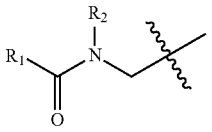

and $R_1$ is a linear or branched, saturated, unsaturated, or partially saturated hydrocarbyl having about 8 to about 22 carbon atoms and $R_2$ is hydrogen or a hydrocarbyl having about 1 to about 2 carbon atoms.

The foregoing lubricating oil may comprise an engine oil.

In some embodiments, the additive package comprises at least two different friction modifiers. In an embodiment, the at least two friction modifiers in the additive package are represented by Formula I.

In some embodiments, R is a linear or branched, saturated, unsaturated, or partially saturated hydrocarbyl having from about 8 to about 22 carbon atoms, or about 8 to about 18 carbon atoms, or about 8 to about 15 carbon atoms, or about 10 to about 12 carbon atoms.

In some embodiments, R is represented by:

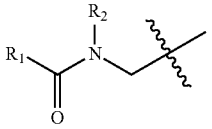

where $R_1$ is a linear or branched, saturated, unsaturated, or partially saturated hydrocarbyl having from about 8 to about 22 carbon atoms, or about 10 to about 20 carbon atoms, or about 12 to about 18 carbon atoms. $R_2$ is hydrogen or a hydrocarbyl having about 1 to about 2 carbon atoms.

Suitable examples of compounds of Formula I include the oxazoline of oleoyl sarcosine, the oxazoline of oleic acid, lauric acid, coconut fatty acid, and stearic acid.

The compounds represented by Formula I can be prepared by any one of a number of synthesis methods. For example, the compounds can be prepared from amino hydroxy compounds via their fatty acid amides, or can be prepared by reacting an amino hydroxy compound with a nitrile.

In preparing the compounds of the Formula I via their fatty acid amides, a suitable amino hydroxy compound is reacted with an aliphatic carboxylic acid at an elevated temperature to yield an amide. The temperature is then increased to split out water and form the hydrocarbyl oxazoline. The temperature for the initial amide formation and final hydrocarbyl oxazoline formation depends on the reaction materials employed and generally is within the range of 150° C. to 170° C. for the initial step of the reaction and about 250° C. for the final step of the reaction.

The process of preparing compounds of the Formula I by reacting an amino hydroxyl compound with a nitrile is described, for example, in U.S. Pat. No. 3,979,405.

Another known method of preparing compounds of the Formula I involves reacting oleic acid and stearic acid with tris(hydroxymethyl) aminomethane, as described, for example, in U.S. Pat. No. 4,618,436.

In an embodiment, the compound of Formula I is the reaction product of an aliphatic carboxylic acid of formula (II):

(II)

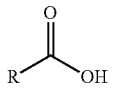

and an amino hydroxy compound of formula (III):

(III)

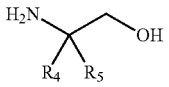

wherein R is a linear or branched, saturated, unsaturated, or partially saturated hydrocarbyl having about 8 to about 22 carbon atoms or wherein R is

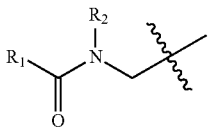

and $R_1$ is a linear or branched, saturated, unsaturated, or partially saturated hydrocarbyl having about 8 to about 22 carbon atoms and $R_2$ is hydrogen or a hydrocarbyl having about 1 to about 2 carbon atoms, and wherein $R_4$ and $R_5$ are the same or are independently hydrogen or hydroxy methylene.

The one or more friction modifiers of the present disclosure may comprise from about 0.05 to about 2.0 wt. %, or 0.1 to about 2.0 wt. %, or about 0.2 to about 1.8 wt. %, or about 0.5 to about 1.5 wt. % of the total weight of the lubricating oil composition. Suitable amounts of the compounds of the friction modifiers may be incorporated in additive packages to deliver the proper amount of friction modifier to the fully formulated lubricating oil. The one or more friction modifiers of the present disclosure may comprise from about 0.1 to about 20 wt. %, or about 1.0 to about 20 wt. %, or about 2.0 to about 18 wt. %, or about 5.0 to about 15 wt. % of the total weight of the additive package.

The one or more friction modifiers when used in combination may be used in a ratio of from 1:100 to 100:1; from 1:1:100 to 1:100:1 to 100:1:1; or any other suitable ratio and so on.

The additive package of the present disclosure may optionally further comprise at least one metal dialkyl dithio phosphate salt. In some embodiments, the additive package comprises at least two different metal dialkyl dithio phosphate salts. The metal in the dialkyl dithio phosphate salts may be an alkali metal, alkaline earth metal, aluminum, lead, tin, molybdenum, manganese, nickel, copper, or zinc.

The two alkyl groups on the metal dialkyl dithio phosphate salt may be the same or different and each contains from 1 to 18 carbon atoms, or from 2 to 12 carbon atoms, or from 4 to 12 carbon atoms, or from 7 to 18 carbon atoms.

In some embodiments, 100 mole percent of the alkyl groups of the at least one metal dialkyl dithio phosphate salt may be derived from primary alcohol groups. In some embodiments, 100 mole percent of the alkyl groups of the at least one metal dialkyl dithio phosphate salt may be derived from secondary alcohol groups. In some embodiments, mixtures of all primary alcohol metal dialkyl dithio phosphate salts and all secondary alcohol metal dialkyl dithio phosphate salts are mixed together in a ratio of about 1:100 to about 100:1, or about 10:90 to about 90:10, or about 20:80 to about 80:20, or about 30:70 to about 70:30, or about 40:60 to about 60:40, or about 50:50.

The alcohols suitable for producing the metal dialkyl dithio phosphate salts may be primary alcohols, secondary alcohols, or a mix of primary and secondary alcohols. In an embodiment, the additive package comprising one metal dialkyl dithio phosphate salt derived from an alcohol comprising a primary alkyl group and another metal dialkyl dithio phosphate salt derived from an alcohol comprising a secondary alkyl group. In another embodiment, metal dialkyl dithio phosphate salt is derived from at least two secondary alcohols. The alcohols may contain any of branched, cyclic, or straight chains.

In some embodiments, the alkyl groups of the at least one metal dialkyl dithio phosphate salt may be derived from a mixture of primary and secondary alcohol groups. The alcohol mixture may be a ratio of 1:100 to 100:1, or about 10:90 to about 90:10, or about 20:80 to about 80:20, or about 30:70 to about 70:30, or about 40:60 to about 60:40, or about 50:50.

The at least one metal dialkyl dithio phosphate salt may be selected from zinc dihydrocarbyl dithiophosphates (ZDDP) which are oil soluble salts of dihydrocarbyl dithiophosphoric acids and may be represented by the following formula:

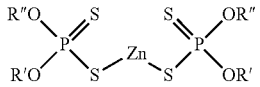

wherein R' and R" may be the same or different hydrocarbyl moieties containing from 1 to 18, for example 2 to 12, carbon atoms and including moieties such as alkyl, alkenyl, aryl, arylalkyl, alkaryl, and cycloaliphatic moieties. The R' and R" groups may be alkyl groups of 2 to 8 carbon atoms. Thus, the moieties may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e., R' and R") in the dithiophosphoric acid will generally be about 5 or greater.

The dialkyl dithio phosphate metal salts may be prepared in accordance with known techniques by first forming a dialkyl dithiophosphoric acid (DDPA), usually by reaction of one or more alcohols and then neutralizing the formed DDPA with a metal compound. To make the metal salt, any basic or neutral metal compound could be used but the oxides, hydroxides and carbonates are most generally employed. The zinc dialkyl dithio phosphates may be made by a process such as the process generally described in U.S. Pat. No. 7,368,596.

In an embodiment, the additive package may include a metal dialkyl dithio phosphate salt derived from an alcohol comprising a primary alkyl group and another metal dialkyl dithio phosphate salt derived from an alcohol comprising a secondary alkyl group.

In some embodiments, the at least one metal dialkyl dithio phosphate salt may be present in an engine oil in an amount sufficient to provide from about 100 to about 1000 ppm phosphorus, or from about 200 to about 1000 ppm phosphorus, or from about 300 to about 900 ppm phosphorus, or from about 500 to about 800 ppm phosphorus, or from about 550-700 ppm phosphorus.

In some embodiments, the metal dialkyl dithio phosphate salt may be a ZDDP. In some embodiments, the additive package may comprise two or more metal dialkyl dithio phosphate salts wherein one is a ZDDP. The ZDDP may comprise a combination of about 60 mol % primary alcohol and about 40 mol % secondary alcohol.

In some embodiments, the additive package of the present disclosure may further comprise at least one dispersant. The at least one dispersant may be a succinimide dispersant such as a hydrocarbyl-substituted succinimide. The dispersant may be an ashless dispersant.

Hydrocarbyl-substituted succinic acylating agents can be used to make hydrocarbyl-substituted succinimides. The hydrocarbyl-substituted succinic acylating agents include, but are not limited to, hydrocarbyl-substituted succinic acids, hydrocarbyl-substituted succinic anhydrides, the hydrocarbyl-substituted succinic acid halides (for example, the acid fluorides and acid chlorides), and the esters of the hydrocarbyl-substituted succinic acids and lower alcohols (e.g., those containing up to 7 carbon atoms), that is, hydrocarbyl-substituted compounds which can function as carboxylic acylating agents.

Hydrocarbyl substituted acylating agents can be made by reacting a polyolefin or chlorinated polyolefin of appropriate molecular weight with maleic anhydride. Similar carboxylic reactants can be used to make the acylating agents. Such reactants can include, but are not limited to, maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters.

The molecular weight of the olefin can vary depending upon the intended use of the substituted succinic anhydrides. Typically, the substituted succinic anhydrides can have a hydrocarbyl group of from about 8-500 carbon atoms. However, substituted succinic anhydrides used to make lubricating oil dispersants can typically have a hydrocarbyl group of about 40-500 carbon atoms. With high molecular weight substituted succinic anhydrides, it is more accurate to refer to number average molecular weight (Mn) since the olefins used to make these substituted succinic anhydrides can include a mixture of different molecular weight components resulting from the polymerization of low molecular weight olefin monomers such as ethylene, propylene and isobutylene.

The mole ratio of maleic anhydride to olefin can vary widely. It can vary, for example, from about 5:1 to about 1:5, or for example, from about 1:1 to about 3:1. With olefins such as polyisobutylene having a number average molecular weight of about 500 to about 7000, or as a further example, about 800 to about 3000 or higher and the ethylene-alpha-olefin copolymers, the maleic anhydride can be used in stoichiometric excess, e.g. 1.1 to 3 moles maleic anhydride per mole of olefin. The unreacted maleic anhydride can be vaporized from the resultant reaction mixture.

Polyalkenyl succinic anhydrides can be converted to polyalkyl succinic anhydrides by using conventional reducing conditions such as catalytic hydrogenation. For catalytic hydrogenation, a suitable catalyst is palladium on carbon. Likewise, polyalkenyl succinimides can be converted to polyalkyl succinimides using similar reducing conditions.

The polyalkyl or polyalkenyl substituent on the succinic anhydrides employed herein can be generally derived from polyolefins which are polymers or copolymers of mono-olefins, particularly 1-mono-olefins, such as ethylene, propylene and butylene. The mono-olefin employed can have about 2 to about 24 carbon atoms, or as a further example, about 3 to about 12 carbon atoms. Other suitable mono-olefins include propylene, butylene, particularly isobutylene, 1-octene and 1-decene. Polyolefins prepared from such mono-olefins include polypropylene, polybutene, polyisobutene, and the polyalphaolefins produced from 1-octene and 1-decene.

In some aspects, the dispersant can include one or more alkenyl succinimides of an amine having at least one primary amino group capable of forming an imide group. The alkenyl succinimides can be formed by conventional methods such as by heating an alkenyl succinic anhydride, acid, acid-ester, acid halide, or lower alkyl ester with an amine containing at least one primary amino group. The alkenyl succinic anhydride can be made readily by heating a mixture of polyolefin and maleic anhydride to about 180-220° C. The polyolefin can be a polymer or copolymer of a lower monoolefin such as ethylene, propylene, isobutene and the like, having a number average molecular weight in the range of about 300 to about 3000 as determined by gel permeation chromatography (GPC).

Amines which can be employed in forming the ashless dispersant include any that have at least one primary amino group which can react to form an imide group and at least one additional primary or secondary amino group and/or at least one hydroxyl group. A few representative examples are: N-methyl-propanediamine, N-dodecylpropanediamine, N-aminopropyl-piperazine, ethanolamine, N-ethanol-ethylenediamine, and the like.

Suitable amines can include alkylene polyamines, such as propylene diamine, dipropylene triamine, di-(1,2-butylene) triamine, and tetra-(1,2-propylene)pentamine. A further example includes the ethylene polyamines which can be depicted by the formula $H_2N(CH_2CH_2—NH)_nH$, wherein n can be an integer from about one to about ten. These include: ethylene diamine, diethylene triamine (DETA), triethylene tetramine (TETA), tetraethylene pentamine (TEPA), pentaethylene hexamine (PEHA), and the like, including mixtures thereof in which case n is the average value of the mixture. Such ethylene polyamines have a primary amine group at each end so they can form mono-alkenylsuccinimides and bis-alkenylsuccinimides. Commercially available ethylene polyamine mixtures can contain minor amounts of branched species and cyclic species such as N-aminoethyl piperazine, N,N'-bis(aminoethyl)piperazine, N,N'-bis(piperazinyl)ethane, and like compounds. The commercial mixtures can have approximate overall compositions falling in the range corresponding to diethylene triamine to tetraethylene pentamine. The molar ratio of polyalkenyl succinic anhydride to polyalkylene polyamines can be from about 1:1 to about 3.0:1.

In some aspects, the dispersant can include the products of the reaction of a polyethylene polyamine, e.g. triethylene tetramine or tetraethylene pentamine, with a hydrocarbon substituted carboxylic acid or anhydride made by reaction of a polyolefin, such as polyisobutene, of suitable molecular weight, with an unsaturated polycarboxylic acid or anhydride, e.g., maleic anhydride, maleic acid, fumaric acid, or the like, including mixtures of two or more such substances.

Polyamines that are also suitable in preparing the dispersants described herein include N-arylphenylenediamines, such as N-phenylphenylenediamines, for example, N-phenyl-1,4-phenylenediamine, N-phenyl-1,3-phenylendiamine, and N-phenyl-1,2-phenylenediamine; aminothiazoles such as aminothiazole, aminobenzothiazole, aminobenzothiadiazole and aminoalkylthiazole; aminocarbazoles; aminoindoles; aminopyrroles; amino-indazolinones; aminomercaptotriazoles; aminoperimidines; aminoalkyl imidazoles, such as 1-(2-aminoethyl)imidazol-e, 1-(3-aminopropyl)imidazole; and aminoalkyl morpholines, such as 4-(3-aminopropyl)morpholine. These polyamines are described in more detail in U.S. Pat. Nos. 4,863,623 and 5,075,383.

Additional polyamines useful in forming the hydrocarbyl-substituted succinimides include polyamines having at least one primary or secondary amino group and at least one tertiary amino group in the molecule as taught in U.S. Pat. Nos. 5,634,951 and 5,725,612. Non-limiting examples of suitable polyamines include N,N,N",N"-tetraalkyldialkylenetriamines (two terminal tertiary amino groups and one central secondary amino group), N,N,N',N"-tetraalkyltrialkylenetetramines (one terminal tertiary amino group, two internal tertiary amino groups and one terminal primary amino group), N,N,N',N",N'"-pentaalkyltrialkylenetetramines (one terminal tertiary amino group, two internal tertiary amino groups and one terminal secondary amino group), tris(dialkylaminoalkyl)aminoalkylmethanes (three terminal tertiary amino groups and one terminal primary amino group), and like compounds, wherein the alkyl groups are the same or different and typically contain no more than about 12 carbon atoms each, and which can contain from about 1 to about 4 carbon atoms each. As a further example, these alkyl groups can be methyl and/or ethyl groups. Polyamine reactants of this type can include dimethylaminopropylamine (DMAPA) and N-methyl piperazine.

Hydroxyamines suitable for herein include compounds, oligomers or polymers containing at least one primary or secondary amine capable of reacting with the hydrocarbyl-substituted succinic acid or anhydride. Examples of hydroxyamines suitable for use herein include aminoethylethanolamine (AEEA), aminopropyldiethanolamine (APDEA), ethanolamine, diethanolamine (DEA), partially propoxylated hexamethylene diamine (for example HMDA-2PO or HMDA-3PO), 3-amino-1,2-propanediol, tris(hydroxymethyl)aminomethane, and 2-amino-1,3-propanediol.

The mole ratio of amine to hydrocarbyl-substituted succinic acid or anhydride can range from about 1:1 to about 3.0:1. Another example of a mole ratio of amine to hydrocarbyl-substituted succinic acid or anhydride may range from about 1.5:1 to about 2.0:1.

In some embodiments, the lubricating oils include at least one polyisobutylene succinimide that is post-treated. The post-treatment may be carried out with one or more compounds selected from the group consisting of boron compounds, anhydrides, aldehydes, ketones, phosphorus compounds, epoxides, and carboxylic acids. U.S. Pat. Nos. 7,645,726; 7,214,649; and 8,048,831 describe some suitable post-treatment methods and post-treated products.

Post treatment may be carried out by, for example, by treating the dispersant with maleic anhydride and boric acid as described, for example, in U.S. Pat. No. 5,789,353, or by treating the dispersant with nonylphenol, formaldehyde and glycolic acid as described, for example, in U.S. Pat. No. 5,137,980.

In an embodiment, a polyisobutylene succinimide dispersant is post-treated with a boron compound, and the boron content of the lubricant is in the range of from about 200 to about 500 ppm, or in the range of from about 300 to about 500 ppm, or in the range from about 300 to about 400 ppm.

In some embodiments, the polyalkylene succinimide dispersant of the present disclosure may be represented by the formula:

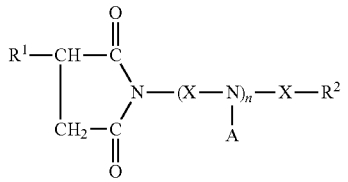

which $R^1$ is hydrocarbyl moiety having from about 8 to 800 carbon atoms, X is a divalent alkylene or secondary hydroxy substituted alkylene moiety having from 2 to 3 carbon atoms, A is hydrogen or a hydroxyacyl moiety selected from the group consisting of glycolyl, lactyl, 2-hydroxy-methyl propionyl and 2,2'-bishydroxymethyl propionyl moieties and in which at least 30 percent of said moieties represented by A are said hydroxyacyl moieties, n is an integer from 1 to 6, and $R^2$ is a moiety selected from the group consisting of $—NH_2$, —NHA, wherein A is as defined above, or a hydroxcarbyl substituted succinyl moiety having the formula:

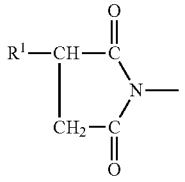

wherein $R^1$ is as defined above.

In some other embodiments, the polyalkylene succinimide dispersant of the present disclosure may be represented by the formula:

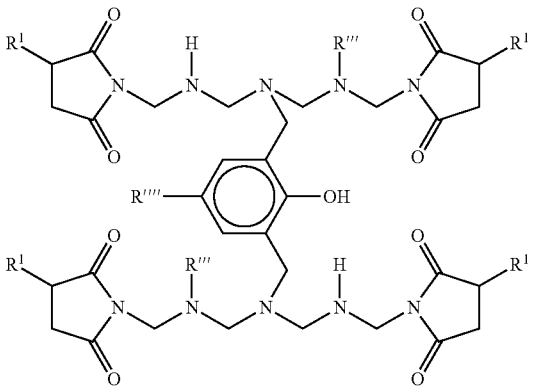

where $R^1$ is a hydrocarbyl moiety having from 8 to 800 carbon atoms and has a number average molecular weight ranging from about 500 to about 10,000; or $R^1$ has a number average molecular weight ranging from about 500 to about 3,000.

In some embodiments, the polyalkylene succinimides have a polyisobutylene residue derived from a polyisobutylene with a number average molecular weight greater than about 900, or in the range of from about 900 to about 5000, or in the range of from about 1200 to about 5000, or in the range of from 1200 to about 3000, or in the range of from about 1200 to about 2000, or about 1200.

In some other embodiments, the polyisobutylene succinimide dispersants have a polyisobutylene residue derived from a polyisobutylene having greater than about 50% terminal vinylidene, or greater than about 55% terminal vinylidene, or greater than 60% terminal vinylidene, or greater than about 70% terminal vinylidene, or greater than about 80% terminal vinylidene. Such a polyisobutylene residue is also referred to as highly reactive polyisobutylene ("HR—PIB"). HR—PIB having a number average molecular weight ranging from about 800 to about 5000 is particularly suitable for use in the present disclosure. Conventional, non-highly reactive PIB typically has less than 50 mol %, less than 40 mol %, less than 30 mol %, less than 20 mol %, or less than 10 mol % content of terminal vinylidene.

An HR—PIB having a number average molecular weight ranging from about 900 to about 3000 may be suitable for the engine oils of the present disclosure. Such an HR—PIB is commercially available, or can be synthesized by the polymerization of isobutene in the presence of a non-chlorinated catalyst such as boron trifluoride, as described in U.S. Pat. Nos. 4,152,499 and 5,739,355. When used in the aforementioned thermal ene reaction, HR—PIB may lead to higher conversion rates in the reaction, as well as lower amounts of sediment formation, due to increased reactivity.

The dispersants can be used in an amount sufficient to provide up to about 20 wt. %, based upon the final weight of the lubricating or engine oil composition. Another amount of the dispersant that can be used may be about 0.1 wt. % to about 15 wt. %, or about 0.1 wt. % to about 10 wt. %, or about 3 wt. % to about 10 wt. %, or about 1 wt. % to about 6 wt. %, or about 7 wt. % to about 12 wt. %, based upon the final weight of the lubricating or engine oils of the present disclosure.

In some embodiments, the additive package of the present disclosure may further comprise at least one detergent. In some exemplary embodiments, the engine oils may include two or more different detergents. In some embodiments, the detergent may be a sulfur-free detergent. It may be advantageous under certain circumstances to use sulfur-free detergents, because sulfur is known to be poisonous to deNox catalysts and zinc/moly phosphates are key contributors to cause plugging of the exhaust particulate filters.

In some embodiments, the detergent comprises a sulfonate, a phenate, or a salicylate. Further, these detergents may comprise calcium, magnesium, or sodium. Examples include a calcium sulfonate, a magnesium sulfonate, a sodium sulfonate, a calcium phenate, and/or a zinc phenate.

The phenate may be derived from at least one alkyl phenol. There may be multiple alkyl groups on a phenol. The alkyl groups of the alkyl phenol may be branched or unbranched. Suitable alkyl groups contain from 4 to 50, or from 9 to 45, or from 12 to 40 carbon atoms. A particularly suitable alkyl phenol is the $C_{12}$-alkyl phenol obtained by alkylating phenol with propylene tetramer. The alkyl phenate may be modified by reaction with carboxylic acid.

Suitable alkyl phenates can be prepared by reacting an alkyl phenol, e g octyl, nonyl, n-decyl, cetyl or dioctyl phenol with an alkali metal base or an alkaline earth metal base e.g. barium hydroxide octohydrate. For making a corresponding overbased phenate, the phenol is reacted with excess base, and the excess neutralised with an acidic gas, e g. carbon dioxide.

The phenate detergent may be sulphurised, which are prepared by reacting the alkyl phenate with elemental sulphur to give a complex reaction product, free alkyl phenol or volatile material in the reaction product may be removed by steam distillation.

The sulfonate detergents may have an alkyl group with formula R—$SO_3$M where M is a metal and R is a substantially saturated aliphatic hydrocarbyl substituent containing from about 50 to 300, or from about 50 to 250 carbon atoms. "Substantially saturated" means that at least about 95% of the carbon-to-carbon covalent linkages are saturated. Too many sites of unsaturation make the molecule more easily oxidized, degraded and polymerized.

Other suitable examples of sulfonate detergents include olefin sulfonates, which are well known in the art. Generally they contain long chain alkenyl sulfonates or long chain hydroxyalkane sulfonates (with the OH being on a carbon atom which is not directly attached to the carbon atom bearing the —$SO_3$— group). Usually, the olefin sulfonate detergent comprises a mixture of these two types of compounds in varying amounts, often together with long chain disulfonates or sulfate-sulfonates. Such olefin sulfonates are described in many patents, such as U.S. Pat. Nos. 2,061,618; 3,409,637; 3,332,880; 3,420,875; 3,428,654; 3,506,580.

Yet other suitable sulfonate detergents include alkylbenzene sulfonates, such as described in U.S. Pat. No. 4,645,623.

The salicylate detergents may be derived from salicylic acids or substituted salicylates, wherein one or more of the hydrogen atoms is replaced with a halogen atom, particularly chlorine or bromine, with hydroxy, straight and branched chain of length from 4 to 45 carbon atoms, or from 10 to 30 carbon atoms of alkyl, hydroxyalkyl, alkenyl, and alkaryl groups. Examples of suitable alkyl groups include: octyl, nonyl, decyl, dodecyl, pentadecyl, octadecyl, eicosyl, docosyl, tricosyl, hexacosyl, triacontyl, dimethylcyclohexyl, ethylcyclohexyl, methylcyclohexylmethyl and cyclohexylethyl.

The detergents suitable for the present disclosure may be metal salts, such as alkali or alkaline earth metal salts. The metal in these detergents may be calcium, magnesium, potassium, sodium, lithium, barium, or mixtures thereof. In some embodiments, the detergent is free of barium. A suitable detergent may include alkali or alkaline earth metal salts of petroleum sulfonic acids and long chain mono- or di-alkylarylsulfonic acids with the aryl group being one of benzyl, tolyl, and xylyl. Mixtures of salts of two or more different alkali and/or alkaline earth metals can be used. Likewise, salts of mixtures of two or more different acids or two or more different types of acids (e.g., one or more calcium phenates with one or more calcium sulfonates) can also be used.

Examples of suitable metal-containing detergents for the present disclosure include, but are not limited to, such substances as lithium phenates, sodium phenates, potassium phenates, calcium phenates, magnesium phenates, sulphurised lithium phenates, sulphurised sodium phenates, sulphurised potassium phenates, sulphurised calcium phenates, and sulphurised magnesium phenates wherein each aromatic group has one or more aliphatic groups to impart hydrocarbon solubility; the basic salts of any of the foregoing phenols or sulphurised phenols (often referred to as "overbased" phenates or "overbased sulphurised phenates"); lithium sulfonates, sodium sulfonates, potassium sulfonates, calcium sulfonates, and magnesium sulfonates wherein each sulphonic acid moiety is attached to an aromatic nucleus which in turn usually contains one or more aliphatic substituents to impart hydrocarbon solubility; the basic salts of any of the foregoing sulfonates (often referred to as "overbased sulfonates"; lithium salicylates, sodium salicylates, potassium salicylates, calcium salicylates, and magnesium salicylates wherein the aromatic moiety is usually substituted by one or more aliphatic substituents to impart hydrocarbon solubility; the basic salts of any of the foregoing salicylates (often referred to as "overbased salicylates"); the lithium, sodium, potassium, calcium and magnesium salts of hydrolysed phosphosulphurised olefins having 10 to 2000 carbon atoms or of hydrolysed phosphosulphurised alcohols and/or aliphatic-substituted phenolic compounds having 10 to 2000 carbon atoms; lithium, sodium, potassium, calcium and magnesium salts of aliphatic carboxylic acids and aliphatic-substituted cycloaliphatic carboxylic acids; the basic salts of the foregoing carboxylic acids (often referred to as "overbased carboxylates" and many other similar alkali and alkaline earth metal salts of oil-soluble organic acids.

The detergent in the lubricating oil of the present disclosure may be neutral, low based, or overbased detergents, and mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, and methylene bridged phenols. Suitable detergents and their methods of preparation are described in greater detail in numerous patent publications, including U.S. Pat. No. 7,732,390 and references cited therein.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, the MR, is greater than one. Such salts are commonly referred to as overbased, hyperbased, or superbased salts and may be salts of organic sulfur acids, carboxylic acids, or phenols.

Overbased detergents are well known in the art and may be alkali or alkaline earth metal overbased detergents. Such detergents may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The overbased detergents may have a metal ratio of from 1.1:1, or from 2:1, or from 4:1, or from 5:1, or from 7:1, or from 10:1.

In some embodiments, the detergent of the lubricating oils of the present disclosure is effective at reducing or preventing rust in an engine. In an embodiment, the detergent has a TBN of up to 450, from 80 to 350. In some embodiments, the lubricating oil has two detergents, and wherein the first detergent has a TBN of 40 to 450 and the second detergent has a TBN of up to 80. In some exemplary embodiments, the TBN of the detergent in the lubricating oil is up to about 450, or in the range of from about 80 to 350.

The detergent in the lubricating oils may comprise from about 0.1 wt. % to about 15 wt. %, or about 0.2 wt. % to about 10 wt. %, or about 0.3 to about 8 wt. %, or about 1 wt. % to about 4 wt. %, or greater than about 4 wt. % to about 8 wt. % of the total weight of the lubricating oil.

The additive package and lubricating oil of the present disclosure may further comprise one or more optional components. Some examples of these optional components include antioxidants, other antiwear agents, boron-containing compounds, extreme pressure agents, other friction modifiers in addition to the friction modifiers of the present disclosure, phosphorus-containing compounds, molybdenum-containing component(s), compound(s) or substituent(s), antifoam agents, titanium-containing compounds, viscosity index improvers, pour point depressants, and diluent oils. Other optional components that may be included in the additive package of the additive package and engine oil of the present disclosure are described below.

Each of the lubricating oils described above may be formulated as engine oils.

In another aspect, the present disclosure relates to a method of using any of the lubricating oils described above for improving or reducing thin film friction. In another aspect, the present disclosure relates to a method of using any of the lubricating oils described above for improving or reducing boundary layer friction. In another aspect, the present disclosure relates to a method of using any of the lubricating oils described above for improving or reducing both thin film friction and boundary layer friction. These methods can be used for lubrication of surfaces of any type described herein.

In yet another aspect, the present disclosure provides a method for improving thin film and boundary layer friction in an engine comprising the step of lubricating the engine with an engine oil comprising a major amount of a base oil and a minor amount of an additive package as disclosed herein. Suitable friction modifiers are those of the Formula I described above. The additive package may comprise two or more friction modifiers each independently selected from the Formula I.

In yet another aspect, the present disclosure provides a method for improving boundary layer friction in an engine comprising the step of lubricating the engine with an engine oil comprising a major amount of a base oil and a minor amount of an additive package comprising a friction modifier as disclosed herein. Suitable friction modifiers are those of the Formula I described above. The additive package may comprise two or more friction modifiers each independently selected from the Formula I.

In yet another aspect, the present disclosure provides a method for improving thin film friction in an engine comprising the step of lubricating the engine with an engine oil comprising a major amount of a base oil and a minor amount of an additive package comprising a friction modifier as disclosed herein. Suitable friction modifiers are those of the Formula I described above. The additive package may comprise two or more friction modifiers each independently selected from the Formula I.

Base Oil

The base oil used in the lubricating oil compositions herein may be selected from any of the base oils in Groups I-V as specified in the American Petroleum Institute (API) Base Oil Interchangeability Guidelines. The five base oil groups are as follows:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may sometimes be referred to as synthetic fluids in the industry.

The base oil used in the disclosed lubricating oil composition may be a mineral oil, animal oil, vegetable oil, synthetic oil, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source with or without little further purification treatment. Refined oils are similar to unrefined oils except that they have been treated by one or more purification steps, which may result in the improvement of one or more properties. Examples of suitable purification techniques are solvent extraction, secondary distillation, acid or base extraction, filtration, percolation, and the like. Oils refined to the quality of an edible oil may or may not be useful. Edible oils may also be called white oils. In some embodiments, lubricant compositions are free of edible or white oils.

Re-refined oils are also known as reclaimed or reprocessed oils. These oils are obtained in a manner similar to that used to obtain refined oils using the same or similar processes. Often these oils are additionally processed by techniques directed to removal of spent additives and oil breakdown products.

Mineral oils may include oils obtained by drilling, or from plants and animals and mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully-hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In an embodiment, oils may be prepared by a Fischer-Tropsch gas-to-liquid synthetic procedure as well as from other gas-to-liquid oils.

The amount of the oil of lubricating viscosity present may be the balance remaining after subtracting from 100 wt. % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt. %, greater than about 60 wt. %, greater than about 70 wt. %, greater than about 80 wt. %, greater than about 85 wt. %, or greater than about 90 wt. %.

Antioxidants

The lubricating oil compositions herein also may optionally contain one or more antioxidants. Antioxidant compounds are known and include, for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidants may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In an embodiment the hindered phenol antioxidant may be an ester and may include, e.g., an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight of the antioxidant, based upon the final weight of the lubricating oil composition. In some embodiments, the antioxidant may be a mixture of about 0.3 to about 1.5% diarylamine and about 0.4 to about 2.5% high molecular weight phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In an embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

The one or more antioxidant(s) may be present in ranges of from about 0 wt. % to about 20 wt. %, or about 0.1 wt. % to about 10 wt. %, or about 1 wt. % to about 5 wt. %, of the lubricating composition.

Antiwear Agents

The lubricating oil compositions herein also may optionally contain one or more antiwear agents. Examples of suitable antiwear agents include, but are not limited to, a metal thiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. The metal in the dialkyl dithio phosphate salts may be an alkali metal, alkaline earth metal, aluminum, lead, tin, molybdenum, manganese, nickel, copper, titanium, or zinc. The phosphorus containing antiwear agents are more fully described in European Patent No. 0612 839.

The antiwear agent may be present in ranges of from about 0 wt. % to about 15 wt. %, or about 0.01 wt. % to about 10 wt. %, or about 0.05 wt. % to about 5 wt. %, or about 0.1 wt. % to about 3 wt. % of the total weight of the lubricating composition.

Boron-Containing Compounds

The lubricating oil compositions herein may optionally contain one or more boron-containing compounds.

Examples of boron-containing compounds include borate esters, borated fatty amines, borated epoxides, borated detergents, and borated dispersants, such as borated succinimide dispersants, as disclosed in U.S. Pat. No. 5,883,057.

The boron-containing compound, if present, can be used in an amount sufficient to provide up to about 8 wt. %, about 0.01 wt. % to about 7 wt. %, about 0.05 wt. % to about 5 wt. %, or about 0.1 wt. % to about 3 wt. % of the total weight of the lubricating composition.

Extreme Pressure Agents

The lubricating oil compositions herein also may optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated waxes; organic sulfides and polysulfides such as dibenzyldisulfide, bis(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers

The lubricating oil compositions herein may also optionally contain one or more additional friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanidines, alkanolamides, phosphonates, metal-containing compounds, glycerol esters, sulfurized fatty compounds and olefins, sunflower oil and other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In a embodiments the friction modifier may be a long chain fatty acid ester. In an embodiment the long chain fatty acid ester may be a mono-ester, or a di-ester, or a (tri)glyceride. The friction modifier may be a long chain fatty amide, a long chain fatty ester, a long chain fatty epoxide derivative, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291.

A friction modifier may be present in amounts of about 0 wt. % to about 10 wt. %, or about 0.01 wt. % to about 8 wt. %, or about 0.1 wt. % to about 4 wt. %, based on the total weight of the lubricant composition.

Molybdenum-Containing Components

The lubricating oil compositions herein may also contain one or more molybdenum-containing compounds. An oil-soluble molybdenum compound may have the functional performance of an antiwear agent, an antioxidant, a friction modifier, or any combination of these functions. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In an embodiment the oil-soluble molybdenum compound may be selected from the group consisting of molybdenum dithiocarbamates, molybdenum dialkyldithiophosphates, amine salts of molybdenum compounds, and mixtures thereof. In an embodiment the oil-soluble molybdenum compound may be a molybdenum dithiocarbamate.

Suitable examples of molybdenum compounds which may be used include commercial materials sold under trade names such as Molyvan 822™, Molyvan™ A, Molyvan 2000™ and Molyvan 855™ from R. T. Vanderbilt Co., Ltd., and Sakura-Lube™ S-165, S-200, S-300, S-310G, S-525, S-600, S-700, and S-710, available from Adeka Corporation, and mixtures thereof. Suitable molybdenum compounds are described in U.S. Pat. No. 5,650,381; and U.S. Reissue Pat. Nos. Re 37,363 E1; Re 38,929 E1; and Re 40,595 E1.

Additionally, the molybdenum compound may be an acidic molybdenum compound. Included are molybdic acid, ammonium molybdate, sodium molybdate, potassium molybdate, and other alkali metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897.

Another class of suitable organo-molybdenum compounds are trinuclear molybdenum compounds, such as those of the formula $Mo_3S_kL_nQ_z$ and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, or at least 25, at least 30, or at least 35 carbon atoms. Additional suitable molybdenum compounds are described in U.S. Pat. No. 6,723,685.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum in the lubricant composition.

Viscosity Index Improvers

The lubricating oil compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 2012/0101017 A1.

The lubricating oil compositions herein also may optionally contain one or more dispersant viscosity index improvers in addition to a viscosity index improver or in lieu of a viscosity index improver. Suitable dispersant viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt. % to about 20 wt. %, about 0.1 wt. % to about 15 wt. %, about 0.1 wt. % to about 12 wt. %, or about 0.5 wt. % to about 10 wt. % based on the total weight, of the lubricating composition.

Other Optional Additives

Other additives may be selected to perform one or more functions required of a lubricating fluid. Further, one or more of the mentioned additives may be multi-functional and provide other functions in addition to or other than the function prescribed herein.

A lubricating composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxanes.

Suitable pour point depressants may include polymethylmethacrylates or mixtures thereof. Pour point depressants may be present in an amount sufficient to provide from about 0 wt. % to about 1 wt. %, about 0.01 wt. % to about 0.5 wt. %, or about 0.02 wt. % to about 0.04 wt. %, based upon the total weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, the lubricating composition or engine oil is devoid of a rust inhibitor.

The rust inhibitor can be used in an amount sufficient to provide about 0 wt. % to about 5 wt. %, about 0.01 wt. % to about 3 wt. %, about 0.1 wt. % to about 2 wt. %, based upon the total weight of the lubricating oil composition.

In general terms, a suitable crankcase lubricant may include additive component(s) in the ranges listed in the following table.

TABLE 2

| Component | Wt. % (Suitable Embodiments) | Wt. % (Suitable Embodiments) |
|---|---|---|
| Dispersant(s) | 0.1-10.0 | 1.0-5.0 |
| Antioxidant(s) | 0.1-5.0 | 0.01-3.0 |
| Detergent(s) | 0.1-15.0 | 0.2-8.0 |
| Ashless TBN booster(s) | 0.0-1.0 | 0.01-0.5 |
| Corrosion inhibitor(s) | 0.0-5.0 | 0.0-2.0 |
| Metal dihydrocarbyldithiophosphate(s) | 0.1-6.0 | 0.1-4.0 |
| Ash-free phosphorus compound(s) | 0.0-6.0 | 0.0-4.0 |
| Antifoaming agent(s) | 0.0-5.0 | 0.001-0.15 |
| Antiwear agent(s) | 0.0-1.0 | 0.0-0.8 |
| Pour point depressant(s) | 0.0-5.0 | 0.01-1.5 |

TABLE 2-continued

| Component | Wt. % (Suitable Embodiments) | Wt. % (Suitable Embodiments) |
|---|---|---|
| Viscosity index improver(s) | 0.0-20.0 | 0.25-10.0 |
| Friction modifier(s) | 0.01-5.0 | 0.05-2.0 |
| Base oil(s) | Balance | Balance |
| Total | 100 | 100 |

The percentages of each component above represent the total weight percent of each component, based upon the total weight of the final lubricating oil composition. The remainder or balance of the lubricating oil composition consists of one or more base oils.

Additives used in formulating the compositions described herein may be blended into the base oil individually or in various sub-combinations. However, it may be suitable to blend all of the component(s) concurrently using an additive concentrate (i.e., additives plus a diluent, such as a hydrocarbon solvent).

EXAMPLES

The following examples are illustrative, but not limiting, of the methods and compositions of the present disclosure. Other suitable modifications and adaptations of the variety of conditions and parameters normally encountered in the field, and which are obvious to those skilled in the art, are within the scope of the disclosure.

Example 1

Reaction Product of Oleoyl Sarcosine and THAM

A 500 mL resin kettle equipped with overhead stirrer, Dean Stark trap, and a thermocouple was charged with 175.6 g (0.5 mol) oleoyl sarcosine, 60.6 g (0.5 mol) 2-amino-2-(hydroxymethyl)propane-1,3-diol, and 218.2 g process oil. The reaction mixture was heated at 180° C. under nitrogen for 6 hours. The reaction mixture was then heated at 180° C. under vacuum for 2 hours. The reaction mixture was cooled and transferred into a container affording 409.3 g of product.

Example 2

Reaction Product of Oleic Acid and THAM (alternative: 2-(Heptadec-8-en-1-0)-4,5-dihydroxazole-4,4-diyl)dimethanol A 500 mL resin kettle equipped with overhead stirrer, Dean Stark trap, and a thermocouple was charged with 169.5 g (0.6 mol) oleic acid, 72.7 g (0.6 mol) 2-amino-2-(hydroxymethyl)propane-1,3-diol, and 231.4 g process oil. The reaction mixture was heated at 180° C. under nitrogen for 6 hours. The reaction mixture was then heated at 180° C. under vacuum for 2 hours. The reaction mixture was cooled and transferred into a container affording 428.2 g of product.

Blends of lubricating oils according to the present disclosure were prepared using hydrocarbyl oxazolines of the Formula I as friction modifiers. The hydrocarbyl oxazolines used in these blends were the oxazoline of oleyl sarcosine and the oxazoline of oleic acid. For comparison, lubricating oils with no friction modifier were also prepared.

The lubricants were subjected to High Frequency Reciprocating Rig (HFRR) and thin film function (TFF) tests. A HFRR from PCS Instruments was used for measuring boundary lubrication regime friction coefficients. The friction coefficients were measured at 130° C. between an SAE 52100 metal ball and an SAE 52100 metal disk. The ball was oscillated across the disk at a frequency of 20 Hz over a 1 mm path, with an applied load of 4.0 N. The ability of the lubricant to reduce boundary layer friction is reflected by the determined boundary lubrication regime friction coefficients.

The TFF test measures thin-film lubrication regime traction coefficients using a Mini-Traction Machine (MTM) from PCS Instruments. These traction coefficients were measured at 130° C. with an applied load of 35N between an ANSI 52100 steel disk and an ANSI 52100 steel ball as oil was being pulled through the contact zone at an entrainment speed of 500 mm/s. A slide-to-roll ratio of 20% between the ball and disk was maintained during the measurements. The ability of lubricant to reduce thin film friction is reflected by the determined thin-film lubrication regime traction coefficients.

The base lubricating composition used in the blends of Table 3 was an SAE 5W-20 GF-5 quality oil formulated without a friction modifier. The test blends included this same base lubricating composition with the specified friction modifier.

Comparative Blend A included only this same base lubricating composition without any added friction modifier (FM).

The HFRR and TFF test results of these lubricating oils are listed in Table 3. The coefficient of friction for boundary layer friction (HFRR) and the traction coefficient for thin film friction (TFF) are significantly lower in lubricants containing hydrocarbyl oxazolines, as compared to lubricants with no friction modifiers (FM). These blends demonstrate that lubricating oils according to the present disclosure can effectively reduce thin film friction as compared with a lubricant without a friction modifier.

TABLE 3

| Blends | Friction Modifier | HFRR | TFF |
|---|---|---|---|
| Comparative A | No FM | 0.160 | 0.092 |
| Blend 1 | Example 1 | 0.142 | 0.038 |
| Blend 2 | Example 2 | 0.122 | 0.055 |

The test fluids of Table 4 utilized as a base fluid, an SAE 5W-20, GF-5 quality oil from which the friction modifier and dispersant has been removed. The test blends were included this same base lubricating composition with the specified friction modifier and the specified dispersant.

Comparative Examples B and C utilized this same base fluid without friction modifier, but formulated with the indicated dispersant.

Blends of lubricating oils according to the present disclosure were prepared using a hydrocarbyl oxazoline as friction modifier and dispersants. The hydrocarbyl oxazoline used in these examples was the oxazoline of oleyl sarcosine.

The lubricants of these blends also contained dispersants. The dispersants used in these lubricating oils were 2100-2300 MW succinimide (Dispersant 1) and borated 1300 MW succinimide (Dispersant 2). The indicated molecular weight refers to the initial HR—PIB reactant.

The lubricating oils were subjected to High Frequency Reciprocating Rig (HFRR) and thin film function (TFF) tests.

The HFRR and TFF test results for these lubricating oils are given in Table 4. The coefficient of friction for boundary layer friction (HFRR) and the traction coefficient for thin film friction (TFF) are significantly lower in lubricants with hydrocarbyl oxazolines, as compared with the same lubricants with no friction modifiers (FM). These reductions are similar when either dispersant is used in the lubricant. It is apparent that lubricating oils according to the present disclosure can effectively reduce thin film friction and boundary layer friction in dispersant-containing lubricants as compared with a dispersant-containing lubricant without a friction modifier.

TABLE 4

| Blend | Friction Modifier | Dispersant | HFRR | TFF |
|---|---|---|---|---|
| Comparative B | No FM | Dispersant 1 | 0.150 | 0.083 |
| Comparative C | No FM | Dispersant 2 | 0.160 | 0.083 |
| Blend 5 | Example 1 | Dispersant 1 | 0.116 | 0.045 |
| Blend 6 | Example 1 | Dispersant 2 | 0.129 | 0.062 |

The base lubricating composition used in the blend of Table 5 was an SAE 5W-20 GF-5 quality oil formulated without a friction modifier and detergent. Examples of lubricating oils according to the present disclosure were prepared using the specified friction modifier and the specified detergents. Comparative Examples D-F included only this same base lubricating composition, formulated with the indicated detergent and, without any added friction modifier (FM). The detergents used in the finished fluids included overbased sulfonate (OB sulfonate), neutral sulfonate, and salicylate. The tested detergents were calcium-containing.

The lubricating oils were subjected to High Frequency Reciprocating Rig (HFRR) and thin film function (TFF) tests.

The HFRR and TFF test results for these lubricating oils are given in Table 5. The coefficients of friction for boundary layer friction (HFRR) were significantly lower in lubricants with hydrocarbyl oxazolines and a detergent, as compared to the same lubricants with detergent but no friction modifiers (FM). In addition, the traction coefficient for thin film friction (TFF) was also lower in lubricants with hydrocarbyl oxazolines and overbased sulfonate detergent, comparing with lubricants with overbased detergent but no friction modifiers. The test results for thin film friction when overbased salicylate detergent was used were similar between the two lubricants. It is apparent that lubricating oils according to the present disclosure can effectively reduce boundary layer friction as compared to a lubricant without a friction modifier.

TABLE 5

| Example | Friction Modifier | Detergent | HFRR | TFF |
|---|---|---|---|---|
| Comparative D | No FM | OB sulfonate | 0.154 | 0.069 |
| Example 7 | Example 1 | OB sulfonate | 0.130 | 0.058 |
| Comparative E | No FM | Neutral Sulfonate | 0.158 | 0.041 |
| Example 8 | Example 1 | Neutral Sulfonate | 0.138 | 0.046 |
| Comparative F | No FM | Salicylate | 0.162 | 0.060 |
| Example 9 | Example 1 | Salicylate | 0.138 | 0.046 |

Other embodiments of the present disclosure will be apparent to those skilled in the art from consideration of the specification and practice of the embodiments disclosed herein. It is intended that the specification and examples be considered as exemplary only, with a true scope of the disclosure being indicated by the following claims.

All documents mentioned herein are hereby incorporated by reference in their entirety or alternatively to provide the disclosure for which they were specifically relied upon.

The foregoing embodiments are susceptible to considerable variation in practice. Accordingly, the embodiments are not intended to be limited to the specific exemplifications set forth hereinabove. Rather, the foregoing embodiments are within the spirit and scope of the appended claims, including the equivalents thereof available as a matter of law.

The applicant(s) do not intend to dedicate any disclosed embodiments to the public, and to the extent any disclosed modifications or alterations may not literally fall within the scope of the claims, they are considered to be part hereof under the doctrine of equivalents.

What is claimed is:

1. A lubricating oil comprising a major amount of a base oil and a minor amount of an additive package, wherein the additive package comprises one or more friction modifiers of the Formula I:

(I)

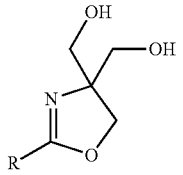

wherein R is a linear or branched, saturated, unsaturated, or partially saturated hydrocarbyl having about 8 to about 22 carbon atoms or wherein R is represented by:

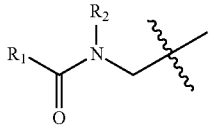

and $R_1$ is a linear or branched, saturated, unsaturated, or partially saturated hydrocarbyl having about 8 to about 22 carbon atoms and $R_2$ is hydrogen or a hydrocarbyl having about 1 to about 2 carbon atoms.

2. The lubricating oil of claim 1, wherein the additive package comprise at least two friction modifiers.

3. The lubricating oil of claim 1, wherein the additive package comprise at least two friction modifiers of the Formula I.

4. The lubricating oil of claim 1, wherein R has from about 8 to about 18 carbon atoms.

5. The lubricating oil of claim 1, wherein R is represented by:

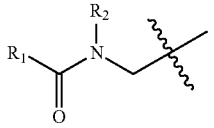

and $R_1$ has from about 10 to about 20 carbon atoms.

6. The lubricating oil of claim 5, wherein $R_1$ has from about 10 to about 18 carbon atoms.

7. The lubricating oil of claim 5, wherein $R_2$ is hydrogen or a methyl group.

8. The lubricating oil of claim 1, wherein the additive package further comprises at least one additive selected from the group consisting of detergents, dispersants, antioxidants, antifoam agents, titanium-containing compounds, phosphorus-containing compounds, viscosity index improvers, pour point depressants, and diluent oils.

9. The lubricating oil composition of claim 1, wherein the lubricating oil is an engine oil.

10. The lubricating oil of claim 1, further comprising at least one metal dialkyl dithio phosphate salt.

11. The lubricating oil of claim 10, wherein the at least one metal dialkyl dithio phosphate salt comprises at least one zinc dialkyl dithio phosphate represented by the following formula:

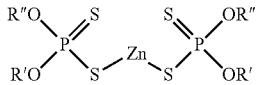

wherein R' and R" may be the same or different hydrocarbyl moieties containing from 1 to 18, carbon atoms and the total number of carbon atoms in the zinc dialkyl dithio phosphate is at least 5.

12. The lubricating oil of claim 11, wherein the R' and R" groups are independently selected from ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl.

13. The lubricating oil of claim 10, wherein the alkyl groups of the at least one metal dialkyl dithio phosphate salt are derived from primary alcohols, secondary alcohols, or mixtures of primary and secondary alcohols.

14. The lubricating oil of claim 10, wherein 100 mole percent of the alkyl groups of the at least one metal dialkyl dithio phosphate salt are derived from primary alcohols.

15. The lubricating oil of claim 10, wherein at least 75 mole percent of the alkyl groups of the at least one metal dialkyl dithio phosphate salt are derived from 4-methyl-2-pentanol.

16. The lubricating oil of claim 10, wherein more than 80 mole percent of the alkyl groups of the at least metal dialkyl dithio phosphate salt are derived from 4-methyl-2-pentanol.

17. The lubricating oil of claim 10, comprising at least two metal dialkyl dithio phosphate salts wherein a first metal dialkyl dithio phosphate salt comprises alkyl groups derived from a primary alcohol and a second metal dialkyl dithio phosphate salt comprises alkyl groups derived from a secondary alcohol.

18. The lubricating oil of claim 1, further comprising at least one dispersant.

19. The lubricating oil of claim 1, further comprising at least one detergent.

20. The lubricating oil of claim 1, comprising from about 0.05 to about 2.0 wt. %, of the one or more friction modifiers of the Formula I.

21. The lubricating oil of claim 1, comprising from about 0.1 to about 2.0 wt. %, of the one or more friction modifiers of the Formula I.

22. The lubricating oil of claim 1, comprising from about 0.5 to about 2.0 wt. %, of the one or more friction modifiers of the Formula I.

23. The lubricating oil of claim 1, wherein the lubricating oil comprises a major amount of a base oil having at least 90% saturates and being selected from a Group II, Group III, Group IV and Group V base oil and mixtures thereof.

24. The lubricating oil of claim 1, wherein the lubricating oil is an engine oil that contains from about 50 to about 1000 ppm of phosphorus.

25. The lubricating oil of claim 1, wherein the additive package comprises a reaction product of oleoyl sarcosine and 2-amino-2-(hydroxymethyl)propane-1,3-diol.

26. The lubricating oil of claim 1, wherein the additive package comprises a reaction product of oleic acid and 2-amino-2-(hydroxymethyl)propane-1,3-diol.

27. The lubricating oil of claim 21, wherein the lubricating oil is an engine oil that contains from about 50 to about 1000 ppm of phosphorus, the lubricating oil comprises a major amount of a base oil having at least 90% saturates and being selected from a Group II, Group III, Group IV and Group V base oil and mixtures thereof and a calcium-containing detergent.

28. The lubricating oil of claim 27 further comprising a zinc dialkyl dithiophosphate.

* * * * *